US006390032B1

(12) United States Patent
Van Klompenburg

(10) Patent No.: US 6,390,032 B1
(45) Date of Patent: May 21, 2002

(54) MOLDABLE INTEGRATED FLUID PASSAGES FOR AN INTERNAL COMBUSTION ENGINE

(75) Inventor: Douglas K. Van Klompenburg, Columbus, IN (US)

(73) Assignee: Technology Holdings, Inc., Columbus, IN (US)

( * ) Notice: Subject to any disclaimer, the term of this patent is extended or adjusted under 35 U.S.C. 154(b) by 0 days.

(21) Appl. No.: 09/507,415

(22) Filed: Feb. 18, 2000

Related U.S. Application Data

(60) Provisional application No. 60/120,748, filed on Feb. 18, 1999.

(51) Int. Cl.[7] ..... F02F 1/10

(52) U.S. Cl. ..... 123/41.72; 123/193.2; 123/195 S

(58) Field of Search ..... 123/195 R, 195 S, 123/41.72, 196 R, 41.83, 41.84, 193.2

(56) References Cited

U.S. PATENT DOCUMENTS

| | | | | | |
|---|---|---|---|---|---|
| 1,287,386 | A | * | 12/1918 | Masury | 123/195 S |
| 1,682,357 | A | * | 8/1928 | Sperry | 123/41.55 |
| 1,826,005 | A | * | 10/1931 | Knox et al. | 123/41.55 |
| 2,664,863 | A | * | 1/1954 | Nallinger | 123/41.72 |
| 3,064,634 | A | * | 11/1962 | Tyce et al. | 123/195 S |
| 4,554,893 | A | * | 11/1985 | Vecellio | 123/195 S |
| 4,630,580 | A | | 12/1986 | Sawaki et al. | |
| 5,094,201 | A | | 3/1992 | Bedi | |
| 5,301,642 | A | | 4/1994 | Matsushiro et al. | |
| 5,601,060 | A | | 2/1997 | Smietanski et al. | |
| 5,937,817 | A | | 8/1999 | Schanz et al. | |

* cited by examiner

*Primary Examiner*—Noah P. Kamen
(74) *Attorney, Agent, or Firm*—Woodard, Emhardt, Naughton, Moriarty & McNett

(57) ABSTRACT

The present invention relates to multiple integrated fluid passages for a internal combustion engine which allow for economical and convenient means for routing fluids in relation to an engine block. For example, the molded passages of the present invention allow coolant to be applied directly to areas needing heat transfer, without requiring the provision of large areas in the engine block to accommodate such cooling fluid. Also, the molded passages of the present invention do not require circular internal passages, so that space-critical items can receive proper distribution of fluid. Also, the molded passages of the present invention allow for economical velocity control of fluids by controlling the sizes of the fluid passage. In a preferred embodiment, the molded passages are formed in a clam shell configuration having an open side and are attached to an exterior surface of the cylinder block, thereby forming an enclosed pathway for fluid flow.

27 Claims, 6 Drawing Sheets

Engine block oil passages

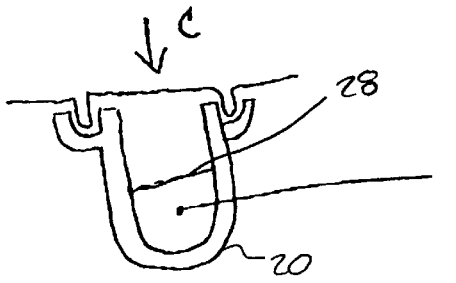
SECT A-A
Auger like Protrusion in fluid Stream
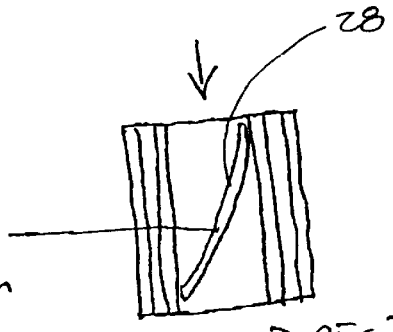
VIEW OF DIRECTION C
FIG. 8
FIG. 7
EXTERNAL Cooling fins
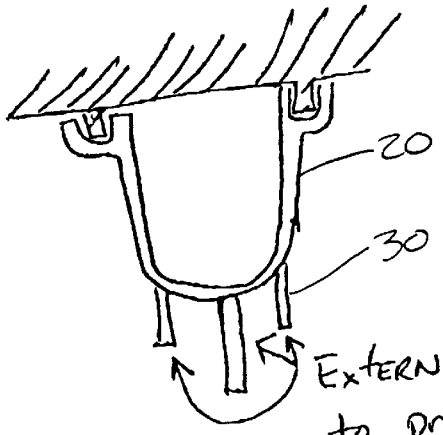
External Fins Added to promote Heat TRANSFER
FIG. 9

MOLDABLE INTEGRATED FLUID PASSAGES FOR AN INTERNAL COMBUSTION ENGINE

CROSS-REFERENCE TO RELATED APPLICATION

This application claims priority benefit from U.S. Provisional patent application Ser. No. 60/120,748, filed Feb. 18, 1999.

TECHNICAL FIELD OF THE INVENTION

The present invention generally relates to internal combustion engines, and, more particularly, to moldable integrated fluid passages for an internal combustion engine.

BACKGROUND OF THE INVENTION

Internal combustion engines are typically built from a rather large engine block to which are added various engine components. The engine block forms the main structural mass of the engine and generally comprises a very large machined or cast metal structure. Formation of the engine block is complicated and relatively expensive due to the need to include various fluid passages, such as cooling water, lubricating oil, air, etc., for proper operation of the engine. Production of such an engine block necessitates the need for expensive dedicated capital equipment, such as machining equipment, including transfer lines, long gun drills, etc.

A large performance and financial improvement would be realized if an internal combustion engine could be constructed without the need for such a large, massive and complicated engine block. The present invention is directed toward meeting this need.

SUMMARY OF THE INVENTION

The present invention relates to multiple integrated fluid passages for a internal combustion engine which allow for economical and convenient means for routing fluids in relation to an engine block. For example, the molded passages of the present invention allow coolant to be applied directly to areas needing heat transfer, without requiring the provision of large areas in the engine block to accommodate such cooling fluid. Also, the molded passages of the present invention do not require circular internal passages, so that space-critical items can receive proper distribution of fluid. Also, the molded passages of the present invention allow for economical velocity control of fluids by controlling the sizes of the fluid passage. In a preferred embodiment, the molded passages formed in a clam shell configuration having an open side and is attached to an exterior surface of the cylinder block, thereby forming an enclosed pathway for fluid flow.

BRIEF DESCRIPTION OF THE DRAWINGS

FIG. 7 is a cross-sectional schematic view of a molded passage of the present invention, illustrating an example of a protrusion therein to create a desirable swirl of fluid flowing within the passage.

FIG. 8 is an end elevational view of the molded passage of FIG. 7.

FIG. 9 is a cross-sectional schematic view of a second embodiment molded passage of the present invention, having external cooling fins formed thereon.

DETAILED DESCRIPTION OF THE PREFERRED EMBODIMENTS

Figure 1:
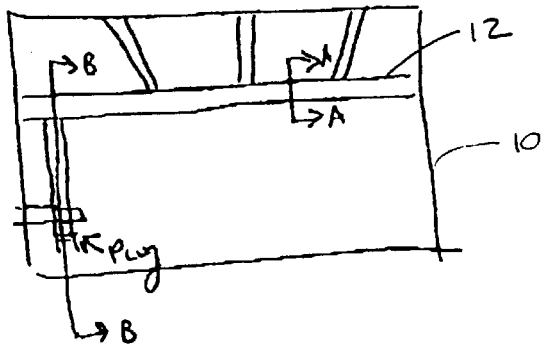
FIG. 1 (PRIOR ART)
FIG. 1 is a cross-sectional schematic diagram of a prior art engine block.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 2:
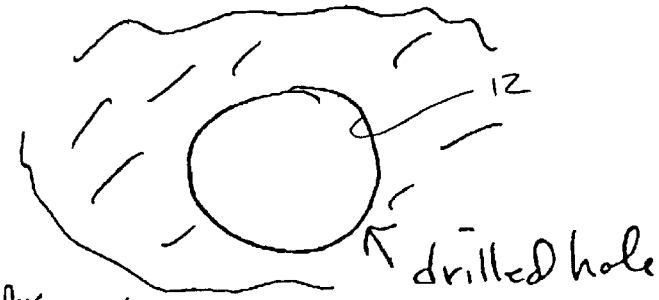
FIG. 2 (PRIOR ART)
FIG. 2 is a cross-sectional schematic diagram of a drilled passage of the engine block of FIG. 1.
Figure 3:
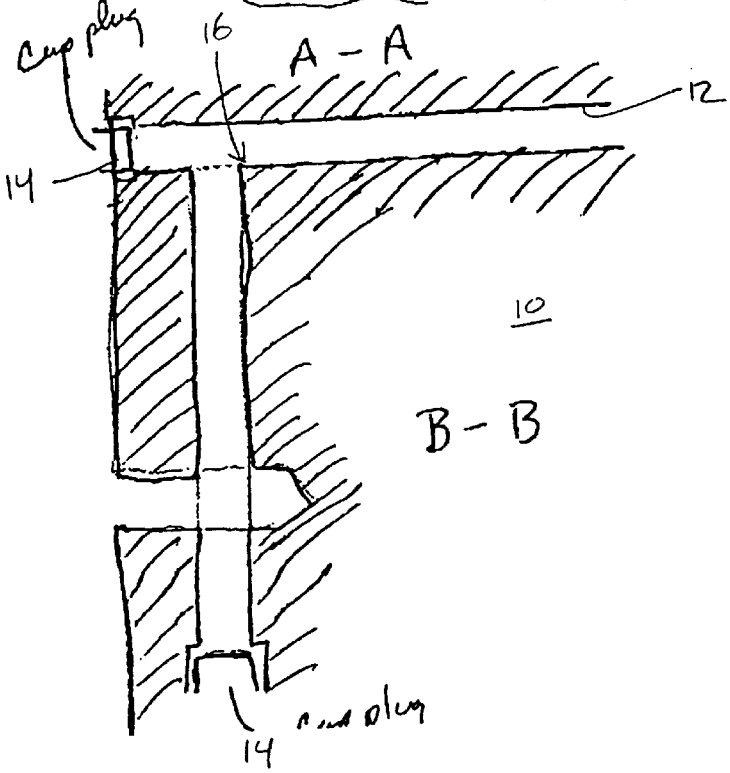
FIG. 3 (PRIOR ART)
FIG. 3 is a cross-sectional schematic diagram of several drilled passages of the engine block of FIG. 1.
Figure 4:
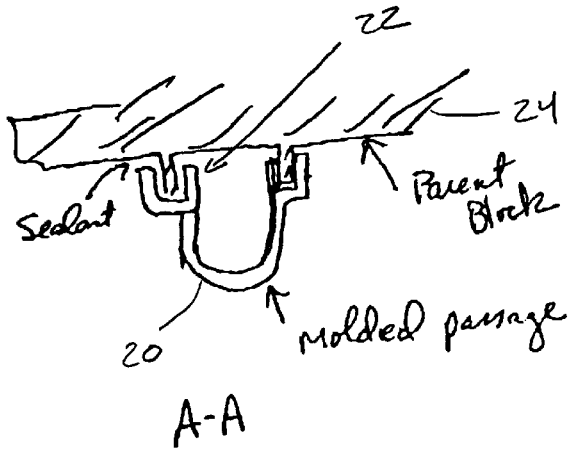
FIG. 4 is a cross-sectional view of a molded passage of the present invention coupled to an exterior surface of an engine block.
Figure 11:
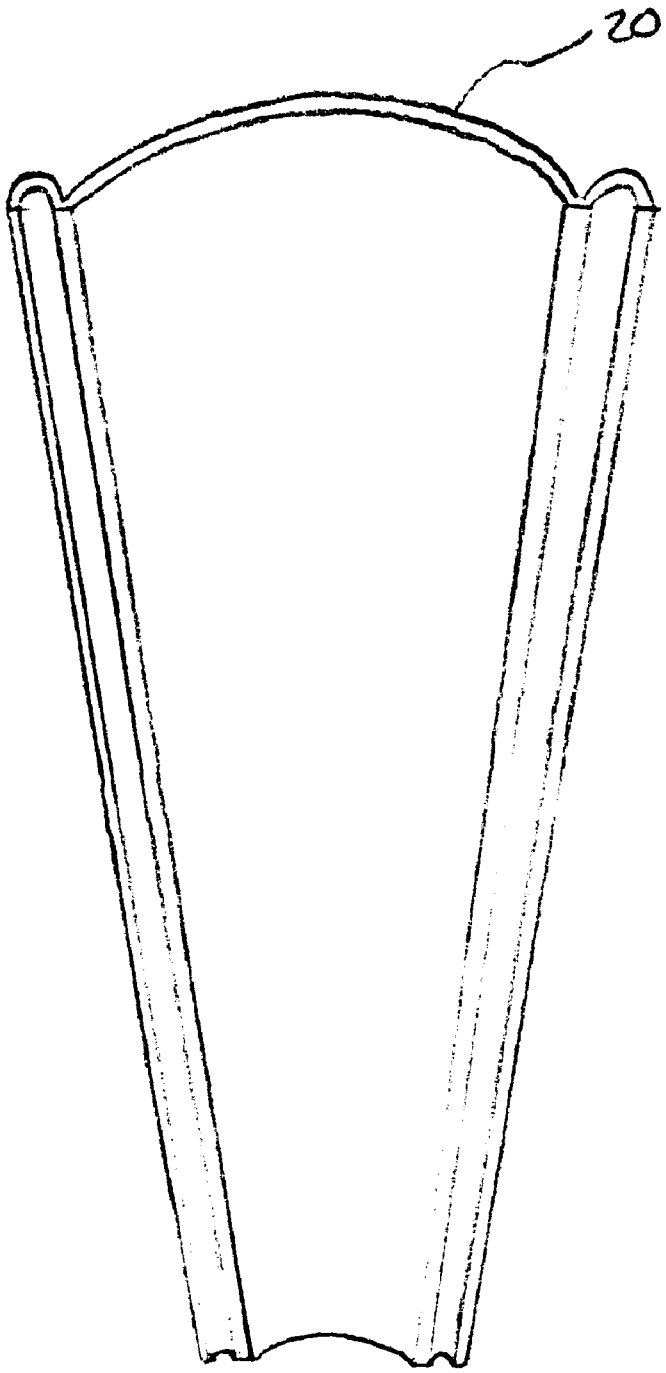
FIG. 11 is a perspective view of a tapered molded passage of the present invention.

With reference to FIG. 1, a schematic diagram of a prior art engine block is illustrated, showing the complicated oil and water passages which are typically formed in such an engine block 10. The passages 12 are machined from a solid piece of metal that forms the engine block 10. As shown in FIGS. 2 and 3, these passages are typically formed by drilling into the engine block 10 from various directions and then inserting plugs 14 to close off areas where it was necessary to pierce the exterior surface of the engine block 10 in order to form a passage. Forming such drilled passages 12 is difficult, expensive and difficult to change once a design has been established. Furthermore, such drilled passages have sharp corners, such as the corner 16, which causes turbulent flow, which is sometimes undesirable and can impact the efficiency of the fluid flowing through the passage 12. In order to alleviate these problems with the prior art fluid passages, the present invention comprehends the use of separately molded "clamshell" passages, which can be adhered to specific portions of the engine. A cross-sectional view of such a passage is shown in FIG. 4. The molded passage 20 is formed with an interface structure 22 at its peripheral edges which mates with the engine block 24 in such a way as to provide a fluid-tight passage. Methods and materials for forming such molded passages and for sealing these passages to another surface are discussed in detail in my pending U.S. patent application, Ser. No. 09/185,979, filed Nov. 4, 1998 and entitled MULTIPLE INTEGRATED OIL PAN AND SUCTION TUBE FOR AN INTERNAL COMBUSTION ENGINE, the specification and drawings of which are incorporated by reference herein in their entirety. Molded passages 20 may be used to carry any fluid or gas within the engine, including but not limited to lubricating oil, cooling water, intake air, etc. The use of separately molded fluid passages 20 allows for great design freedom and flexibility. For example, if it is determined that there is an undesirable fluid pressure drop at one point in the engine, the cross-section of the molded passage 20 in this area can be reduced or a taper may be put into the molded passage 20, as shown in FIG. 11. This is difficult or impossible to do with drilled engine blocks. Furthermore, the molded passage 20 may be formed into any combination of straight and curved sections in these dimensions, allowing the passage to be run over any surface.

Figure 5:
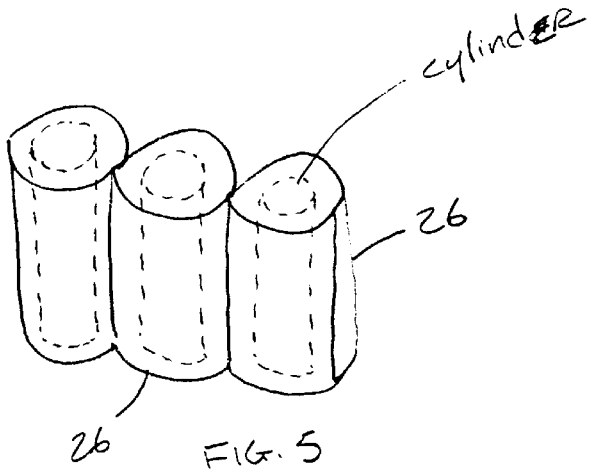
FIG. 5 is a schematic perspective view of multiple cylinder water jack plates formed according to the present invention.
Figure 6:
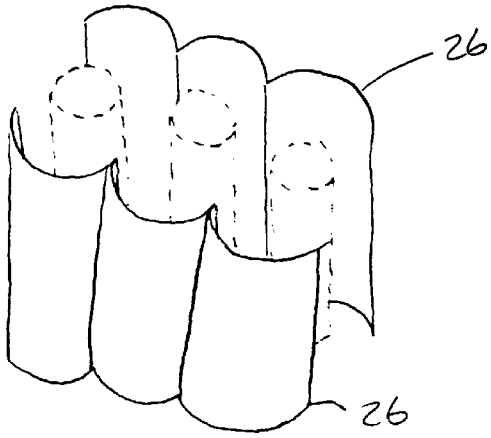
FIG. 6 is an exploded schematic perspective view of the plates of FIG. 5.
Figure 12:
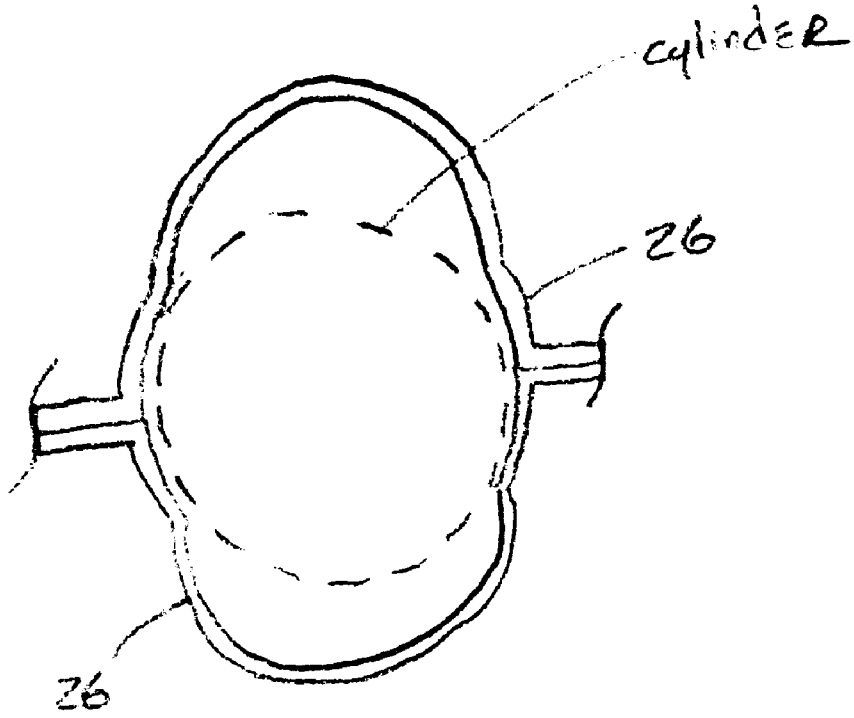
FIG. 12 is a cross-sectional schematic view of the water jacket plates of FIGS. 5 and 6.

Furthermore, the molded passages 20 of the present invention can be used to form the cooling water jacket of an internal combustion engine, thereby obviating the need for such a water jacket formed internal to the engine block, as is done in prior art engines. Not only does this reduce the size of the finished engine, but it eliminates the need for the complicated internal passages that make up the water jacket for most prior art engine blocks. Furthermore, use of the molded passages 20 allows the designer to put the water jacket only where heat is being generated, such as at the top of each cylinder above the piston. Without the need to provide for an internal water jacket and internal oil passages, it is possible to form the engine block in a greatly reduced dimension, whereby molded passages 20 may be fitted to the outside of this reduced engine block in order to provide the necessary fluid and gas flow passages. Additionally, as illustrated in FIGS. 5, 6, and 12, it is possible to cast entire plates for multiple cylinders, wherein each plate 26 may mate to an individual cylinder and contain all of the necessary passages therein, or may, as illustrated, cover multiple cylinders. In the embodiment illustrated in FIGS. 5, 6, and 12, two plates 26 are placed on either side of a multiple bank of cylinders and mate with one another between the cylinders. This allows for the formation of a water jacket nearly completely surrounding the portion of the cylinders to which the plates 26 are attached.

Figure 10:
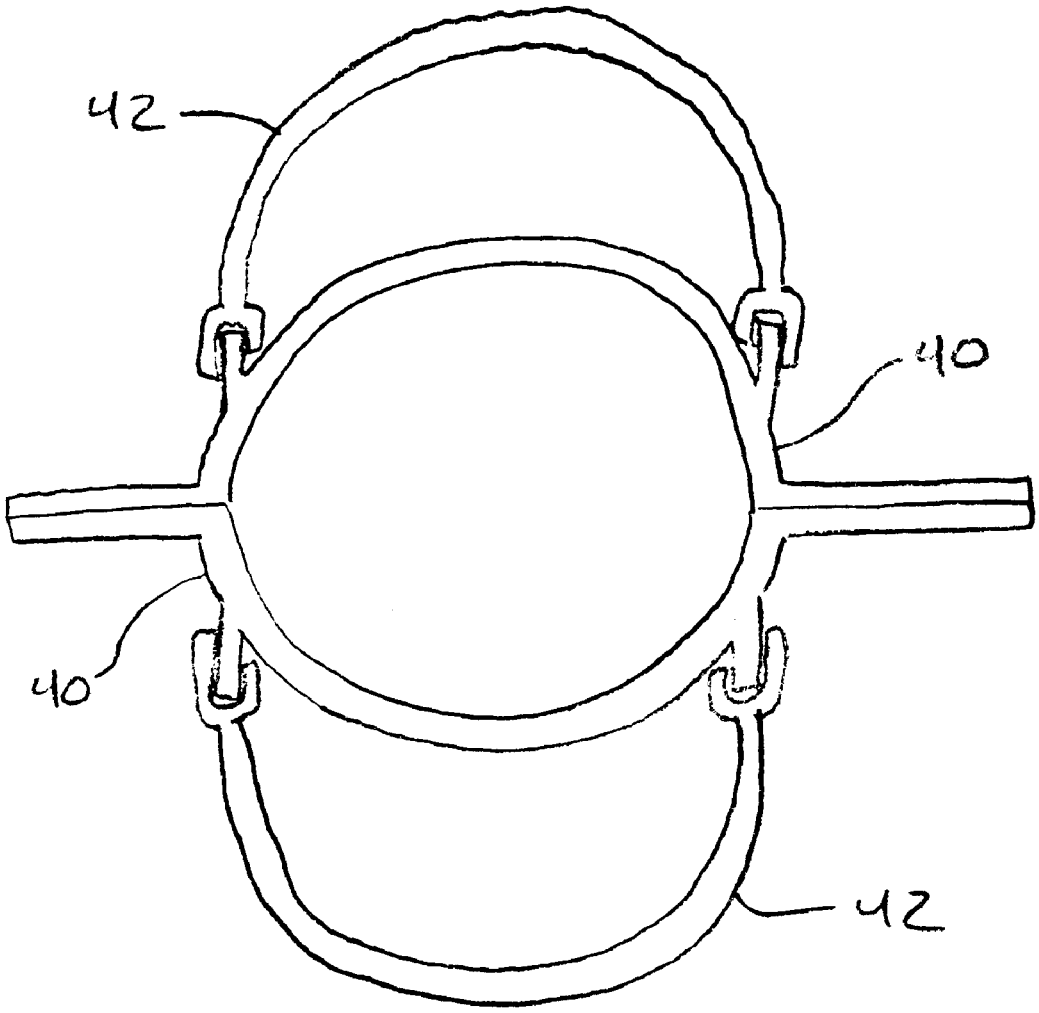
FIG. 10 is a cross-sectional schematic view of an engine cylinder and fluid passages constructed from molded passages according to the present invention.

As shown in FIG. 10, the castings of the present invention may also be used to build up an entire engine from multiple castings. This embodiment would be particularly desirable for a single cylinder engine, such as those used on gasoline engine-powered equipment. In such an embodiment, the cylinder walls would be formed from two castings 40 mated together in a clamshell, with the rest of the engine being made from additional castings 42 which may all be sealed together to form the completed engine.

As illustrated in FIG. 7, swirl-inducing features such as the protrusion 28 may be formed within the molded passage 20 in order to create desirable swirl in the fluid flowing through the passage 20. Also, external cooling fins 30, such as those illustrated in FIG. 9, may be added to the molded passage 20 in order to promote heat transfer to the surrounding environment. Such fins may be desirable on passages carrying cooling water as well as those carrying lubricating oil. Furthermore, it is possible to perform engine cooling with other fluids, such as the lubricating oil, thereby obviating the need for a separate cooling water circuit.

In view of the above description, those having ordinary skill in the art will recognize that the molded passages of the present invention allow for economical velocity control of fluids by controlling the sizes of the fluid passage. Additionally, the molded passages of the present invention allow coolant to be applied directly to areas needing heat transfer, without requiring the provision of large areas in the engine block to accommodate such cooling fluid. Also, the molded passages of the present invention do not require circular internal passages, so that space-critical items can receive proper distribution of fluid. For example, it is possible to form the moldable passage 20 as a flat and wide passage, wherein the cross-sectional area is still adequate for proper fluid flow.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An internal combustion engine comprising:

a cylinder block having an exterior surface and at least one cavity formed therein;

at least one piston disposed within the at least one cavity; and at least one fluid passage coupled to the cylinder block exterior surface, said at least one fluid passage having an open side that is closed by the cylinder block exterior surface when coupled thereto, thereby forming a pathway for fluid flow;

wherein a fluid may be routed through the pathway such that the fluid contacts the cylinder block exterior surface.

2. The internal combustion engine of claim 1, further comprising:

a curved member internal to said pathway, wherein the curved member is adapted to influence fluid flow.

3. The internal combustion engine of claim 1, wherein said pathway forms a portion of a cooling water circuit, whereby said cooling water circuit is external to said cylinder block.

4. The internal combustion engine of claim 1, wherein said at least one fluid passage is coupled to the cylinder block exterior surface by a interface structure comprising a groove and an interlocking fin.

5. The internal combustion engine of claim 4, wherein said interface structure further comprises a sealing material.

6. The internal combustion engine of claim 1, wherein said pathway has a transverse cross-sectional area which varies, said transverse cross-sectional area is varied so as to influence an internal fluid pressure at a plurality of points along the pathway.

7. The internal combustion engine of claim 6, wherein said cross-sectional area is varied so as to generally taper between an inlet and a smaller outlet.

8. The internal combustion engine of claim 1, wherein said at least one fluid passage is cast using a thin-wall die casting technique.

9. The internal combustion engine of claim 1, wherein said at least one fluid passage comprises magnesium.

10. The internal combustion engine of claim 1, further comprising:

external cooling fins extending from said at least one fluid passage.

11. An internal combustion engine comprising:

a cylinder block having an exterior surface and at least one cavity formed therein; and at least one piston disposed within the at least one cavity; and at least one fluid passage coupled to the cylinder block exterior surface, said at least one fluid passage having an open side that is closed by the cylinder block exterior surface when coupled thereto, thereby forming a pathway for fluid flow;

wherein said at least one fluid passage is cast using a thin-wall die casting technique; and wherein a fluid may be routed through the pathway such that the fluid contacts the cylinder block exterior surface; and wherein said at least one fluid passage is coupled to cylinder block external surface by a interface structure comprising a groove, an interlocking fin, and a sealing material.

12. An internal combustion engine comprising:

a cylinder block having an exterior surface and at least one cavity formed therein; and at least one piston disposed within the at least one cavity; and at least one fluid passage coupled to the cylinder block exterior surface, said at least one fluid passage having an open side that is closed by the cylinder block exterior surface when coupled thereto, thereby forming a pathway for fluid flow;

wherein said at least one fluid passage comprises magnesium; and a curved member internal to said pathway, wherein the curved member is adapted to influence fluid flow; and wherein said pathway has a transverse cross-sectional area which varies, said transverse cross-sectional area is varied so as to influence an internal fluid pressure at a plurality of points along the pathway.

13. A cooling water jacket for an internal combustion engine, comprising:

a first pair of first plates, shaped to define at least one internal cavity when mated; and at least one second plate shaped to define at least one cooling passage when coupled to a first pair of first plates;

said at least one internal cavity forming a cylinder of the internal combustion engine, said at least one cooling passage defining a passage for cooling water which substantially surrounds said cylinder.

14. The cooling water jacket of claim 13, further comprising a curved member internal to said passage and adapted to influence water flow.

15. The cooling water jacket of claim 14, further comprising cooling fins external to said passage.

16. The cooling water jacket of claim 13, wherein said pair of plates is formed using thin-wall die casting techniques.

17. An internal combustion engine, wherein a cylinder block is substantially formed by mating at least two plates shaped to define at least one internal cavity, said at least one internal cavity being suitable for use as a cylinder of the internal combustion engine; and at least one fluid passage coupled to an external surface of said cylinder block, said at least one fluid passage having an open side that is closed by said external surface of said cylinder block when coupled thereto, thereby forming a pathway for fluid to flow.

18. The internal combustion engine of claim 17, further comprising:

a curved member internal to said pathway, the curved member is adapted to influence fluid flow.

19. The internal combustion engine of claim 17, wherein said at least one fluid passage is coupled to cylinder block external surface by a interface structure comprising a groove and an interlocking fin.

20. The internal combustion engine of claim 19, wherein said interface structure further comprises a sealing material.

21. The internal combustion engine of claim 17, wherein said pathway has a transverse cross-sectional area which varies, said transverse cross-sectional area is varied so as to influence an internal fluid pressure at a plurality of points along the pathway.

22. The internal combustion engine of claim 21, wherein said cross-sectional area is varied so as to generally taper between an inlet and a smaller outlet.

23. The internal combustion engine of claim 17, wherein said at least one fluid passage is cast using a thin-wall die casting technique.

24. The internal combustion engine of claim 17, wherein said at least one fluid passage comprises magnesium.

25. An internal combustion engine, comprising a cylinder block is substantially formed by mating at least two plates shaped to define at least one internal cavity, said at least one internal cavity being suitable for use as a cylinder of the internal combustion engine and having an exterior surface; and at least one piston disposed within the at least one cavity; and at least one fluid passage coupled to the cylinder block exterior surface, said at least one fluid passage having an open side that is closed by the cylinder block exterior surface when coupled thereto, thereby forming a pathway for fluid flow; said at least one fluid passage is cast using a thin-wall die casting technique; and wherein a fluid may be routed through the pathway such that the fluid contacts the cylinder block exterior surface; and wherein said at least one fluid passage is coupled to cylinder block external surface by a interface structure comprising a groove, an interlocking fin, and a sealing material; and wherein said pathway has external cooling fins extending therefrom.

26. An internal combustion engine, comprising:

a cylinder block substantially formed by mating at least two plates shaped to define at least one internal cavity, said at least one internal cavity being suitable for use as a cylinder of the internal combustion engine; and at least one fluid passage coupled to an external surface of said cylinder block, said at least one fluid passage having an open side that is closed by said external surface of said cylinder block when coupled thereto, thereby forming a pathway for fluid to flow; and a curved member internal to said pathway, the curved member is adapted to influence fluid flow.

27. A cylinder block for all internal combustion engine, comprising at least one pathway for fluid to flow formed only by coupling at least one fluid passage to at least one external surface of the cylinder block, said at least one fluid passage each having an open side that is closed by said external surface of the cylinder block when coupled thereto.

* * * * *